US010391758B2

(12) United States Patent
Desmet et al.

(10) Patent No.: US 10,391,758 B2
(45) Date of Patent: Aug. 27, 2019

(54) SUSTAINABLE LITHOGRAPHIC PRINTING PLATE

(71) Applicant: AGFA GRAPHICS NV, Mortsel (BE)

(72) Inventors: Tim Desmet, Mortsel (BE); Karen Demmers, Mortsel (BE)

(73) Assignee: AGFA NV, Mortsel (BE)

( * ) Notice: Subject to any disclaimer, the term of this patent is extended or adjusted under 35 U.S.C. 154(b) by 0 days.

(21) Appl. No.: 15/523,734

(22) PCT Filed: Oct. 9, 2015

(86) PCT No.: PCT/EP2015/073366
§ 371 (c)(1),
(2) Date: May 2, 2017

(87) PCT Pub. No.: WO2016/071074
PCT Pub. Date: May 12, 2016

(65) Prior Publication Data

US 2017/0320313 A1 Nov. 9, 2017

(30) Foreign Application Priority Data

Nov. 6, 2014 (EP) ..... 14192059

(51) Int. Cl.
*B41N 1/14* (2006.01)
*B41C 1/10* (2006.01)
*B41N 1/08* (2006.01)

(52) U.S. Cl.
CPC ..... *B41C 1/1066* (2013.01); *B41N 1/083* (2013.01); *B41N 1/086* (2013.01); *B41N 1/14* (2013.01)

(58) Field of Classification Search
None
See application file for complete search history.

(56) References Cited

U.S. PATENT DOCUMENTS

2007/0221082 A1* 9/2007 Fukui ..... B41C 1/1066 101/463.1

FOREIGN PATENT DOCUMENTS

| | | | |
|---|---|---|---|
| EP | 1 916 101 | A2 | 4/2008 |
| WO | 2005/105463 | A1 | 11/2005 |
| WO | 2008/010230 | A2 | 1/2008 |

OTHER PUBLICATIONS

Official Communication issued in International Patent Application No. PCT/EP2015/073366, dated Nov. 16, 2015.

* cited by examiner

*Primary Examiner* — Joshua D Zimmerman
(74) *Attorney, Agent, or Firm* — Keating and Bennett, LLP

(57) ABSTRACT

A method of preparing a lithographic printing plate includes the steps printing a liquid on a lithographic support to form a printing area which corresponds to a raster image, wherein the raster image includes a section which has a tone-value from 90% to 100%, and the jetted liquid droplets for this section, on a corresponding part from the printing area on the lithographic support, are contactless with each other.

16 Claims, 10 Drawing Sheets

SUSTAINABLE LITHOGRAPHIC PRINTING PLATE

CROSS REFERENCE TO RELATED APPLICATIONS

This application is a 371 National Stage Application of PCT/EP2015/073366, filed Oct. 9, 2015. This application claims the benefit of European Application No. 14192059.5, filed Nov. 6, 2014, which is incorporated by reference herein in its entirety.

BACKGROUND OF THE INVENTION

1. Field of the Invention

The present invention relates to a sustainable lithographic printing plate, having a long press-life and to a method of preparing such a lithographic plate with a printing device, such as an inkjet CTP system.

2. Description of the Related Art

Lithographic printing, also called offset printing, involves transferring an image on a lithographic printing plate to a rubber blanket, then from the rubber blanket onto a receiver, such as paper. The lithographic printing plate comprises a hydrophobic image area, and a hydrophilic non-image area which are both at the same planographic level. The hydrophobic image area will attract ink, while the hydrophilic non-image area attracts the water based solution. Offset printing is the most common method used today because of its image consistency and cost efficiency. The hydrophobic image area is also called the printing area of the lithographic printing plate.

More information about lithographic printing is disclosed in Kipphan, Helmut (2001). Handbook of print media: technologies and production methods pp. 130-144 (ISBN 3-540-67326-1).

In contrast to lithographic printing wherein the non-printing and printing areas are at the same planographic level, the printing areas are raised with flexography and the printing areas are recessed in gravure printing. For example flexography uses low-viscosity inks, either solvent- or water-based which dry very quickly. The flexographic printing plates have a base-relief (raised image) and print directly to the substrate with a very light impression. The raised image carries the image to be printed. The height of the base-relief, also called relief thickness is in the state-of-the-art of these flexographic printing plates much thicker than the printing areas of a lithographic printing plate. The relief thickness of a flexographic printing plate is in the state-of-the-art minimum 1 mm. The support of a flexographic printing plate is different than the lithographic support of a lithographic printing plate. Flexographic printing plates are made of vulcanized rubber or a variety of ultraviolet-sensitive, curable-polymer resins.

The method of preparing a lithographic printing plate is in the state-of-the-art performed by computer-to-plate device, also called CTP device or CTP system. Computer-to-plate (CTP) is a technology that allows the imaging of aluminium or polyester plates without the use of film. By eliminating the stripping, compositing, and traditional plate making processes, CTP altered the printing industry, which led to reduced prepress times, lower costs of labour, and improved print quality.

Most CTP systems use thermal CTP as opposed to violet CTP, though both systems are effective, depending on the requirements of the printing job.

A thermal CTP method involves the use of thermal lasers to expose and/or remove areas of coating while the lithographic printing plate precursor is being imaged. These lasers are generally at a wavelength of 830 nanometers, but vary in their energy usage depending on whether they are used to expose or ablate material.

A violet CTP method involves the use of lasers with a much lower wavelength, for example 405-410 nanometers. Violet CTP is based on emulsion, comprised in the lithographic printing plate precursor, tuned to visible light exposure.

To obtain a lithographic printing plate by thermal or violet CTP additional steps to the exposure are often necessary such as for example a preheat step, a developing step, a baking step, a gumming step or drying step. Each additional step is time and energy consuming and may involve extra devices such as a gumming unit, a baking oven. A baking step in a baking oven improves the press-life of lithographic printing plates but they are energy consuming and may introduce waviness in the lithographic printing plate, which gives unacceptable print quality issues on print. More information on baking of lithographic printing plates is disclosed in EP1916101 (AGFA GRAPHICS N.V.).

An inkjet CTP method involves a simplification of the preparation of lithographic printing plates wherein the printing areas of a lithographic image are applied on a lithographic support by jetting a liquid. An advantage of inkjet CTP is that no chemical processing, such as developing, is needed to prepare a lithographic printing plate. An example of an inkjet CTP method is disclosed in EP 05736134 A (GLUNZ). In the state-of-the-art inkjet CTP systems such as the Kimosetter 525™ of Kimoto™ or PlateWriter™ 8000 of Glunz & Jenzen™, the maximum runlength with lithographic printing plates of these manufacturers is up to 20000 or 50000 prints on press. These lithographic printing plates have also to be baked to realize up to 50000 prints on press.

In lithographic printing plate technology there is an ever increasing demand for printing plates that combine chemical resistance of the offset ink, such as UV-ink compatibility, sustainability and high robustness on press, especially in abrasive conditions. These requirements have pushed the limits of the current available state-of-the-art CTP systems. More information about the preparation of lithographic printing plates and terminology on lithographic printing plates is disclosed in ISO 12218:1997.

Hence, there is still a need for an improved method for preparing lithographic printing plates with high robustness to enhance the run-length in lithographic printing and with high robustness to enhance chemical and mechanical resistance of the lithographic printing plates, which also enhances the press-life of lithographic printing plates.

SUMMARY OF THE INVENTION

Preferred embodiments of the present invention provide a method of preparing a lithographic printing plate resulting in a lithographic plate having a high press-life, without a baking step having a chemical and physical resistance.

The preparing method in the present invention includes forming printing areas, also called ink-accepting areas, on a lithographic support and thus not coating of a lithographic support for example for better adherence of ink to form printing areas. After the preparing method the lithographic printing plate is mounted on an offset press.

Further advantages and preferred embodiments of the present invention will become apparent from the following description.

DETAILED DESCRIPTION OF THE PREFERRED EMBODIMENTS

Figure 1:
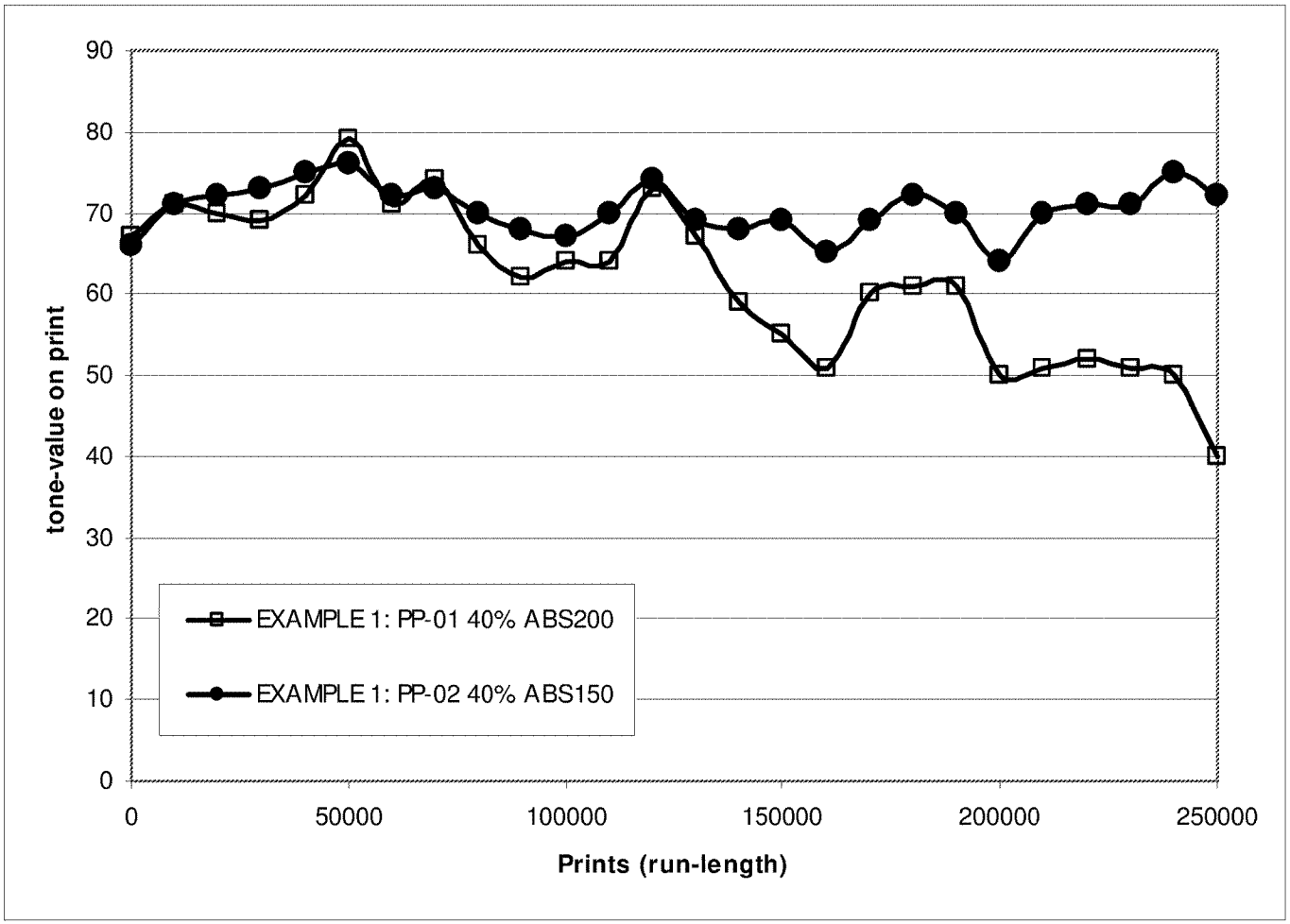
In FIG. 1, the tone-values on print of a 40% patch of the lithographic printing plates PP-01 (Comparative Example) and PP-02 (Inventive example) are given as function of the number of prints. The 40% patches were halftoned with an AM screening method. OFFSETINK-01 was used as printing ink.

A method according to a preferred embodiment of the present invention for preparing a lithographic printing plate by an inkjet CTP system comprises the step of jetting a liquid on a lithographic support in the form of liquid droplets thereby forming a printing area which corresponds to a raster image; and wherein the raster image comprises a section which has a tone-value from 90% to 100%, and wherein the jetted liquid droplets for this section, on corresponding part from the printing area on the lithographic support, are characterized to be contactless with each other at the top of the jetted liquid droplets and more preferably totally contactless with each other.

The top of the jetted liquid droplets means the area from the jetted liquid droplets on the lithographic printing plate the furthest away of the lithographic printing plate. The basis of the jetted liquid droplets means the area from the jetted liquid droplets on the lithographic printing plate that is in contact with the lithographic printing plate.

It is found that the present invention gives a high press-life and that the quality is improved from the state-of-the-art inkjet CTP prepared lithographic printing plates. Due to the contactless jetting at such high dark (=shadowed) sections there is no irregular top and a better flatness of the printing area so a better quality can achieved. A printed liquid droplet, such as a jetted liquid droplet, forms on a lithographic support a substantially rounded drop before curing. It is found that the overlap of jetted liquid droplets has to be avoided to overcome an irregular top, such as non-flatness, on the printing layer, especially where the jetted liquid droplets are overlapping, which reflects then in the printing quality of prints. It is found that the tone-value should not be more than 98.05% else the overlap of the substantially rounded drops is too high and the irregularity in height, (=non-flatness) on the top of the printing area is too large which causes bad printing quality on press such as patterns in the prints.

The contactless printing of the jetted liquid is also an advantage is the sharpness of the printing area. In a preferred embodiment the jetted liquid remains contactless at their tops or in total after curing or drying.

In a preferred embodiment the maximum thickness of the printing area is between 2.0 and 50.0 μm.

The maximum thickness from 2.0 μm to 50.0 μm gives the advantage to enhance the robustness of the lithographic printing plate so higher run-lengths in lithographic printing are made possible. The thick printing area in the present invention results in a more robust lithographic printing plate which has a longer press-life thus a higher number of prints with acceptable print quality than a state-of-the-art lithographic printing plate. The printing areas of lithographic printing plates imposed by thermal or violet CTP systems have a thickness of 1 μm.

After long run-lengths the quality of the prints on press diminished with lithographic printing plates. The diminishing of the quality can be measured by measuring the amount of ink accepting behaviour in a printing area at several periods while printing. If the ink accepting areas diminish in a printing area, it results in a lower print density on print. This is not only for the maximum tone-value (100%) on press but also in the highlights (=tone-values <15%). It is found that the lithographic printing plates of the present invention retain the ink accepting behaviour in the printing area's much longer than the lithographic printing plates in the state-of-the-art which illustrates the advantage of longer press-lifes for the lithographic printing plates of the present invention.

It is also found that the lithographic printing plate of the present invention is more resistant to chemical wear than abrasive lithographic printing plates in the state-of-the-art. Run-lengths of more than 160000 prints with lithographic printing plates of the present invention still demonstrate to have good print quality and no loss in tone-values or print density. Especially the use of UV offset inks is very chemical abrasive for the state-of-the-art lithographic printing plates.

Maximum thickness, larger than 50.0 μm, may deform the rubber blanket while using the lithographic printing plates of the invention so the print quality of lithographic printing becomes worse and unacceptable. Also maximum thicknesses larger than 50.0 μm, should be avoided because it influences the chemical printing process of lithography wherein the repulsion of oil and water becomes unstable due to the thickness transitions from the non-ink accepting parts and the ink accepting parts.

In thermal CTP or violet CTP, the maximum thickness of the printing area is in the state-of-the-art 1 μm. To achieve a thickness according to the present invention a thicker emulsion or coating is needed which results in the generation, at the three stages (=developing, rinsing and gumming) to generate a lot of liquid waste. This is not only an excessive waste damaging to the environment, but also a very high cost for the printing company to purchase these resources and dispose of them. An issue that may occur with thicker emulsions or coating is the effect of lateral exposing on exposing the lithographic printing plate by the thermal or violet CTP. This lateral exposing, also called side-etching or under-cutting, causes deterioration in printing quality and lowers the robustness of the printing plate because the edges of the printing areas become brittle.

Jetting a liquid, as method for printing a liquid, is a preferred embodiment wherein it is more easily to achieve and to control such maximum thickness between 2.0 and 50.0 μm. The jetting of the liquid is performed by an inkjet printhead, such as a piezoelectric inkjet printhead or a valve jet printhead. In this method there is no coating material to be removed which leads to more efficient use of resources.

In a preferred embodiment the method of preparing a lithographic printing plate wherein the corresponding part of the printing area is characterized with a tone-value from 40% to 98% and in a more preferred embodiment the tone-value is from 60% to 97%.

In a preferred embodiment the method of preparing a lithographic printing plate is the static contact angle of a jetted droplet from the liquid on the lithographic support is from 50 degrees to 110 degrees.

In a preferred embodiment the method of preparing a lithographic printing plate wherein maximum thickness of the printing area is between 2.0 and 50.0>μm.

To control the printed liquid, such as controlling the jetted liquid to achieve and to control the maximum thickness in the printing area. The invention may comprise the steps:

—Curing the printed liquid on the lithographic support and forming a plurality of cured drops as printing area.

Curing as used in the preferred embodiment of the present invention encompasses a polymerization and/or crosslinking reaction initiated by actinic radiation, preferably UV radiation, but also the solidification of a hot melt ink which is a liquid at jetting temperature but solidifies on the support.

After impact of the printed liquid on the lithographic support, the liquid flow, such as wetting, in a very small time on the lithographic support before the printed liquid is cured. This very small time is also called the time-to-cure. The cured drops in the present invention are thus the ink accepting drops of the lithographic printing plate. The cured drops may be merged printed or jetted droplets of liquid, for example by coalescence behaviour, or a cured drop may be one printed or jetted droplet of liquid. If a cured drop is formed by one printed or jetted droplet of liquid, it is called a cured single drop and if a cured drop is formed by more than one printed or jetted droplet of liquid, it is called a cured multi drop. A cured single drop corresponds in the present invention to 1 pixel of the raster image. The printing area on the lithographic printing plate of the present invention comprises a plurality of cured drops.

In a preferred embodiment the maximum thickness of a cured drops which forms part of a printing area, is from 2.0 μm until 50.0 μm. In a more preferred embodiment the maximum thickness is from 2.2 μm until 30.0 μm and in a most preferred embodiment the maximum is from 4.0 μm until 20.0 μm. A disadvantage of a maximum thickness above 50.0 μm is the possibility to break the cured drop during the handling of the lithographic printing plate, especially in the highlights wherein the number of cured drops is small and the distances between the cured drops is large.

The curing step is performed by a curing device and in a preferred embodiment the curing step is an ultraviolet curing step, also called UV curing step. The UV curing step is performed by an ultra violet light source, such as a high or low pressure mercury lamp, a cold cathode tube, a black light, an ultraviolet light emitting diode (UV LED), an ultraviolet laser or a flash light. The liquid in this preferred embodiment is an UV curable liquid. The high crosslink density after the UV curing step of the UV curable liquid, such as an aqueous UV curable or UV curable inkjet ink, enables better robustness and long press-life of the lithographic printing plate.

In a preferred embodiment the curing step is an UV bulb curing step wherein the ultra violet light source is an UV bulb lamp or an UV LED curing step wherein the ultra violet light source is a set of UV LED's.

It is found that the shape of a cured single drop is important to have good printing quality also after run-lengths of more than 50000 prints versus the state-of-the-art inkjet CTP systems.

For example it is found that the overlap of jetted liquid droplets has to be avoided to a minimum to overcome an irregular top, such as non flatness, on the printing layer, especially where the jetted liquid droplets are overlapping, which reflects than in the printing quality on press. In a preferred embodiment the plurality of cured drops comprises a cured single drop; and wherein the ratio between the drop diameter of the cured single drop and the printing pitch is from 50:100 to 125:100, more preferably the ratio between the drop diameter of the cured single drop and the printing pitch is from 60:100 to 120:100 and most preferably the ratio between the drop diameter of the cured single drop and the printing pitch is from 70:100 to (200 times the square root of the reciprocal from $\pi$):100, which is mathematic rounded from 70:100 to 113:100. $\pi$ is a mathematical constant, the ratio of a circle's circumference to its diameter, approximately equal to 3.14159. "A ratio of (200 times the square root of the reciprocal from $\pi$):100" happens when the area of the printing pixel, which is a square of the printing pitch on the printing pitch, equals the area of the drop diameter of the cured single drop.

It is also found that for a cured single drop the three dimensional shape is small and elongated, in the perpendicular direction of the plane parallel of the lithographic support, to achieve the maximum thickness of the printing area. In a preferred embodiment the cured single drop comprises:

a first section of the drop which has a shape comprising an outer edge with a first minimum covering circle wherein the first section is a section at a height from the lithographic support between 45% and 55% of the maximum thickness of the cured single drop; and a second section of the cured single drop which has a shape comprising an outer edge with a second minimum covering circle wherein the second section is a section at a height from the lithographic support between 0% and 10% of the maximum thickness of the cured single drop;

and wherein the diameter of the first minimum covering circle is larger or equal than 70% of the diameter from the second minimum covering circle. In a more preferred embodiment the diameter of the first minimum covering circle is larger or equal than 80% of the diameter from the second minimum covering circle and in a most preferred embodiment the cured single drop comprises:

a first section of the cured single drop which has a shape comprising an outer edge with a first minimum covering circle wherein the first section is a section at a height from the lithographic support between 70% and 80% of the maximum thickness of the cured single drop; and a second section of the cured single drop which has a shape comprising an outer edge with a second minimum covering circle wherein the second section is a section at a height from the lithographic support between 0% and 10% of the maximum thickness of the cured single drop;

and wherein the diameter of the first minimum covering circle is larger or equal than 60% of the diameter from the second minimum covering circle.

The chemical and mechanical resistance of the printing area is larger when the cured single drop is substantial cylindrical shaped or substantial rectangular cuboid shaped and smaller when the drop is substantial conical shaped or pyramidical shaped because the top of a substantial cylindrical or rectangular cuboid shaped cured single drop has less chemical and/or mechanical wear in long run-lengths than the top of a substantial conical shaped or pyramidical drop. The wear of a substantial cylindrical shaped or substantial rectangular cuboid shaped cured single drop, for example by long run-lengths, retains its shape and the area at the top of the cured single drop.

In a preferred embodiment the static contact angle of the printed liquid, such as the jetted liquid, on the lithographic support is between 50 degrees and 110 degrees before the curing step and more preferably between 75 degrees and 95 degrees before the curing step. This gives in a small time-to-cure, such as smaller than 1 second, very slant and high cured drops so the thickness of the present invention is achieved.

In a preferred embodiment the time-to cure is within the range of 10 to 1800 ms, more preferably within the range of 20 to 1200 ms. A lithographic support may absorb the liquid to much or to fast to have enough thickness in the printing area so a fast time-to-cure is preferred. In a preferred embodiment the lithographic support is treated with surfactant to prevent the high absorption of the lithographic support so the time-to-cure can be delayed.

In a preferred embodiment of the present invention the raster image comprises a section which has a tone-value from 90% to 100%; and wherein the part of the printing area, corresponding to the section, is characterized with a tone-value from 40% to 98% and in a more preferred embodiment the tone-value is from 60% to 97%. A printed liquid droplet, such as a jetted liquid droplet, forms on a lithographic support a substantially rounded drop before curing. It is found that the overlap of jetted liquid droplets has to be avoided to a minimum to overcome an irregular top, such as non-flatness, on the printing layer, especially where the jetted liquid droplets are overlapping, which reflects than in the printing quality of prints. It is found that the tone-value should not be more than 98.05% else the overlap of the substantially rounded drops is too high and the irregularity in height, (=non-flatness) on the top of the printing area is too large which causes bad printing quality on press such as patterns in the prints.

The jetting of the liquid is preferably a single pass inkjet method to speed up the preparation of the lithographic printing plate.

The present invention is also a lithographic printing plate comprising a lithographic support; and comprising thereon an image-wise distribution of a plurality of ink accepting drops which represents a raster image; and wherein an ink accepting drop of the plurality of ink accepting drops is characterized by having a maximum thickness between 2.0 and 50.0 μm. Preferably all ink accepting drops of the plurality of ink accepting drops are characterized by having a maximum thickness between 2.0 and 50.0 μm. More preferably all ink accepting drops of the plurality of ink accepting drops are characterized by having a maximum thickness between 2.2 μm until 30.0 μm and most preferably from 4.0 μm until 20.0 μm. The image-wise distribution of a plurality of ink accepting drops is a printing area of the lithographic printing plate. In other words the lithographic printing plate of the present invention comprises a lithographic support and provided thereon a plurality of cured drops, forming a printing area which corresponds to a raster image, where the maximum thickness of a printing area is between 2.0 and 50.0 μm.

An ink accepting drop of the plurality of ink accepting drops preferably comprises crosslinked monomers and/or crosslinked oligomers, more preferably comprises polymerized monomers and/or polymerized oligomers and most preferably comprises a cured ultraviolet liquid. In a preferred embodiment the liquid is an inkjet ink comprising inorganic particles.

In a preferred embodiment an ink accepting drop is a cured single drop and has a static contact angle from 50 degrees until 110 degrees on the lithographic support before the step of curing, and in a more preferred embodiment the static contact angle is from 75 degrees until 95 degrees before the step of curing. The steeper the ink accepting drop, for the same droplet volume, the higher the maximum thickness.

In another preferred embodiment an ink accepting drop from the plurality of ink accepting drops is a cured single drop and has a first section of the drop which has a shape comprising an outer edge with a first minimum covering circle wherein the first section is a section at a height from the lithographic support between 45% and 55% of the maximum thickness of the drop; and a second section of the drop which has a shape comprising an outer edge with a second minimum covering circle wherein the second section is a section at a height from the lithographic support between 0% and 10% of the maximum thickness of the drop; and wherein the diameter of the first minimum covering circle is larger or equal than 70% of the diameter of the second minimum covering circle. In other words the average diameter of a cured single drop at a height between 45% and 55% of the maximum height is larger or equal than the average diameter of the cured drop at a height between 0% and 5%.

In another preferred embodiment the lithographic printing plate has a part in the imagewise-distribution of plurality of ink accepting drops that corresponds to a section of a raster image with a tone-value from 90% to 100%; and wherein the imagewise-distribution of plurality of ink accepting drops is characterized with a tone-value from 40% to 98%.

In a preferred embodiment the raster image is a raster image that corresponds to a color separation; and wherein the chroma difference, defined in CIELab, between the color of the color separation and the color of the imagewise-distribution of the plurality of ink accepting drops is smaller than 10 and in more preferred embodiment the chroma difference, defined in CIELAB is smaller than 5.

The chroma difference defined in CIELAB is determined by the following formula in CIELAB-space:

$$dC=\sqrt{(a2-a1)^2+(b2-b1)^2}$$

More information about colour differences and chroma differences is disclosed in disclosed in DR. R. W. G. HUNT. The reproduction of colour. 4th edition. England: Fountain Press, 1987. Colour differences are measured by colorimeters or colour spectrophotometers.

Lithographic Support

The support of the lithographic printing plate has a hydrophilic surface or is provided with a hydrophilic layer. It is also called a lithographic or hydrophilic support. Such a lithographic support has a rectangular shape.

In a preferred embodiment of the invention the lithographic support is a grained and anodized aluminium support.

By graining and/or roughening the aluminium support, both the adhesion of the printing areas and the wetting characteristics of the non-printing areas are improved. By varying the type and/or concentration of the electrolyte and the applied voltage used in the graining step, different type of grains can be obtained. The surface roughness is often expressed as arithmetical mean center-line roughness Ra (ISO 4287/1 or DIN 4762) and may vary between 0.05 and 1.5 μm. The aluminium substrate of the current invention has preferably an Ra value between 0.30 and 0.60 μm, more preferably between 0.35 and 0.55 μm and most preferably between 0.40 and 0.50 μm. The lower limit of the Ra value is preferably 0.1 μm. More details concerning the preferred Ra values of the surface of the grained and anodized aluminium support are described in EP-A 1356926.

By anodizing the aluminium support, its abrasion resistance and hydrophilic nature are improved. The microstructure as well as the thickness of the $Al_2O_3$ layer is determined by the anodizing step. The anodic weight (g/m$^2$ $Al_2O_3$ formed on the aluminium surface) varies between 1.0 and 8.0 g/m$^2$. The anodic weight is preferably between 1.5 g/m$^2$ and 5.0 g/m$^2$, more preferably between 2.5 g/m$^2$ and 4.0 g/m$^2$ and most preferably between 2.5 g/m$^2$ and 3.5 g/m$^2$.

The grained and anodized aluminium support may be subjected to a so-called post-anodic treatment to further improve the hydrophilic character of its surface. For example, the aluminium support may be silicated by treating its surface with a solution including one or more alkali metal silicate compound(s)—such as for example a solution including an alkali metal phosphosilicate, orthosilicate, metasilicate, hydrosilicate, polysilicate or pyrosilicate—at elevated temperatures, for example at 95° C. Alternatively, a phosphate treatment may be applied which involves treating the aluminium oxide surface with a phosphate solution that may further contain an inorganic fluoride. Further, the aluminium oxide surface may be rinsed with a citric acid or citrate solution, gluconic acid, or tartaric acid. This treatment may be carried out at room temperature or may be carried out at a slightly elevated temperature of about 30 to 50° C. A further interesting treatment involves rinsing the aluminium oxide surface with a bicarbonate solution. Still further, the aluminium oxide surface may be treated with polyvinylphosphonic acid, polyvinylmethylphosphonic acid, phosphoric acid esters of polyvinyl alcohol, polyvinylsulphonic acid, polyvinylbenzenesulphonic acid, sulphuric acid esters of polyvinyl alcohol, acetals of polyvinyl alcohols formed by reaction with a sulphonated aliphatic aldehyde, polyacrylic acid or derivates such as GLASCOL E15™ commercially available from Ciba Speciality Chemicals. One or more of these post treatments may be carried out alone or in combination. More detailed descriptions of these treatments are given in GB-A 1084070, DE-A 4423140, DE-A 4417907, EP-A 659909, EP-A 537633, DE-A 4001466, EP-A 292801, EP-A 291760 and U.S. Pat. No. 4,458,005.

In a preferred embodiment, the support is first treated with an aqueous solution including one or more silicate compound(s) as described above followed by a treatment of the support with an aqueous solution including a compound having a carboxylic acid group and/or a phosphonic acid group, or their salts. Particularly preferred silicate compounds are sodium or potassium orthosilicate and sodium or potassium metasilicate. Suitable examples of a compound with a carboxylic acid group and/or a phosphonic acid group and/or an ester or a salt thereof are polymers such as polyvinylphosphonic acid, polyvinylmethylphosphonic acid, phosphoric acid esters of polyvinyl alcohol, polyacrylic acid, polymethacrylic acid and a copolymer of acrylic acid and vinylphosphonic acid. A solution comprising polyvinylphosphonic acid or poly(meth)acrylic acid is highly preferred.

The lithographic support may also be a flexible support, which may be provided with a hydrophilic layer. The flexible support is e.g. paper, plastic film or aluminium. Preferred examples of plastic film are polyethylene terephthalate film, polyethylene naphthalate film, cellulose acetate film, polystyrene film, polycarbonate film. The plastic film support may be opaque or transparent.

The hydrophilic layer is preferably a cross-linked hydrophilic layer obtained from a hydrophilic binder cross-linked with a hardening agent such as formaldehyde, glyoxal, polyisocyanate or a hydrolyzed tetra-alkylorthosilicate. The latter is particularly preferred. The thickness of the hydrophilic layer may vary in the range of 0.2 to 25.0 μm and is preferably 1.0 to 10.0 μm. More details of preferred embodiments of the base layer can be found in e.g. EP-A 1 025 992.

The hydrophilic surface of the support is preferably provided with a surfactant to improve the resolution of the printing plate obtained by the method of the present invention. A higher resolution may be obtained when the spreading of the droplets of the first curable fluid on the hydrophilic surface is minimized. Preferred surfactants are fluorosurfactants, for example the Zonyl® surfactants from Dupont. Also preferred are the more environmentally friendly Tivida® fluorosurfactants from Merck.

The amount of fluorosurfactants on the support surface is preferably between 0.005 and 0.5 $g/m^2$, more preferably between 0.01 and 0.1 $g/m^2$, most preferably between 0.02 and 0.06 $g/m^2$.

A particular preferred lithographic support is a grained and anodized aluminium support as described above, treated with an aqueous solution including one or more silicate compound(s), and of which the surface is provided with a fluorosurfactant.

A Colour Digital Image

A colour digital image, such as RGB-image captured by a digital camera, is a digital image which is made of pixels wherein the pixels are combinations of a set of colorants, which represents an image. If there is only one colorant in the set of colorants and the colorant is black, the colour digital image is also called grayscale digital image. If a colour image is mentioned in the description, it is meant to be a colour digital image. If a gray image is mentioned in the description, it is meant to be a grayscale digital image.

A colorant channel, also called a colorant separation, is in this context a grayscale digital image of the same size as the colour digital image, made of just one of the set of colorants.

The colour digital image may be a CMYK-image, which has four colorant channels: cyan (C), magenta (M), yellow (Y) and black (K) or may be CMYKOG-image, which has 6 colorant channels: cyan (C), magenta (M), yellow (Y), black (K), orange (O) and green (G) or other hexachrome-image.

Each colorant channel may be an N bit-image so each pixel may have intensity from 0 to $(2^N-1)$, such as an 8 bit image or 16 bit image.

The colour digital image is converted with a digital halftoning method, such as amplitude modulated screening, frequency modulated screening or error diffusion, to a colour digital raster image. In most inkjet CTP systems the amount of intensities in the colorant channels of the colour digital raster image, also called a grayscale digital raster image, is from 0 to 1. If the inkjet CTP system uses multi-drop piezoelectric inkjet printhead to jet the droplets on a lithographic support, the amount of intensities in the colorant channels of the colour digital raster image is from 0 to the amount of droplet volumes the multi-drop piezoelectric inkjet printhead jets. The colorant channels of the colour digital raster image are than jetted as lithographic image each on a different lithographic support. If a raster image is mentioned in the description, it is meant to be a grayscale digital raster image.

In a preferred embodiment the method comprises the step: halftoning a colorant separation of a colour digital image to a raster image. In a more preferred embodiment the halftoning step is an amplitude modulated (AM) or a hybrid amplitude modulated screening step and in a most preferred embodiment the halftoning step is a frequency modulated (FM) screening step. Due to the small screen-dots in frequency modulated screening, the robustness of the state-of-the-art lithographic printing plates with printing areas corresponding to images rasterized by a frequency modulated screening is bad versus the robustness of lithographic printing plates with printing areas corresponding to images rasterized by an amplitude modulated screening method. The lithographic printing plates of the present invention do not have this disadvantage anymore.

A preferred screening step to rasterize the image is a cross modulated (XM) screening step which achieves automatic, artefact-free, high resolution raster-images. It applies FM screening steps in the highlights and/or shadows to capture fine details and AM screening steps in the midtones to achieve smooth gradations. A cross modulated (XM) screening method is an example of a hybrid AM screening step.

Inkjet CTP Systems

Inkjet CTP systems is a marking device that is using a printhead such as valve-jet printhead, an inkjet printhead, an piezo-electric printhead, page-wide inkjet arrays or an inkjet printing head assembly with one or more inkjet printheads to jet a liquid to form printing areas of the lithographic image to prepare a lithographic printing plate comprising the lithographic image.

Figure 5:
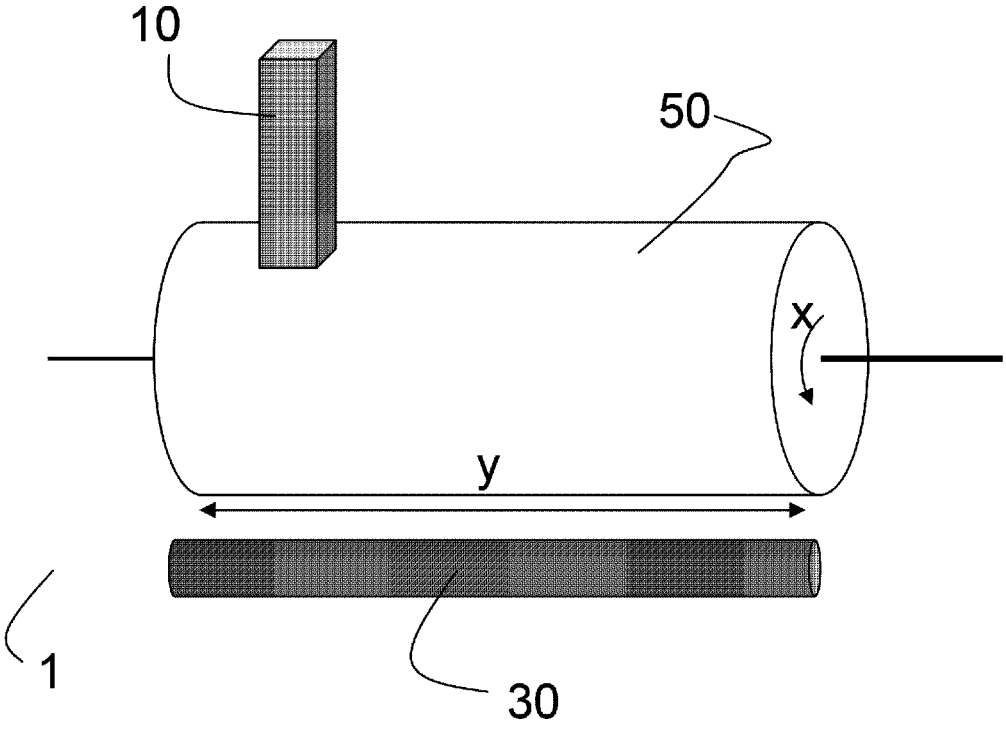
FIG. 5 illustrates a preferred embodiment of a drum-based inkjet CTP system (1) which may be used in a method of preparing a lithographic printing plate according to the present invention. A lithographic support is mounted on a cylindrical drum (50). While the lithographic support rotates in the x-direction, a print head (10), jetting a curable fluid, is moving in the y-direction. The jetted curable fluid is cured by a curing device (30).
Figure 6:
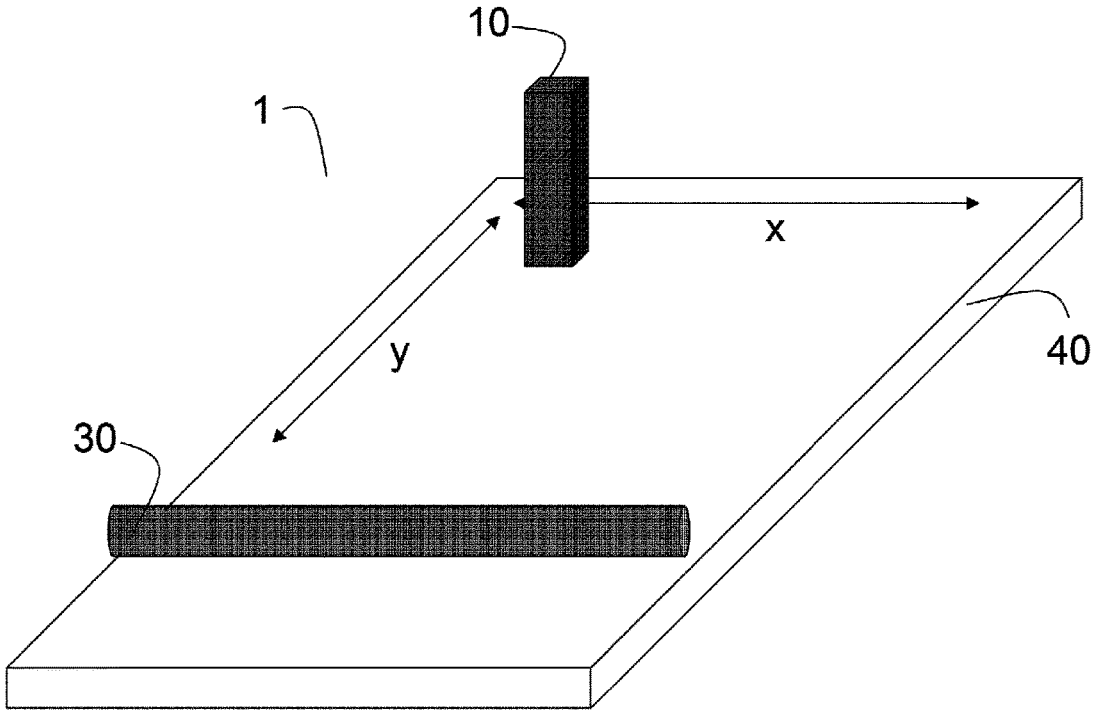
FIG. 6 illustrates a preferred embodiment of an inkjet CTP system (1) as a flat bed printing device which may be used in a method of preparing a lithographic printing plate according to the present invention. A lithographic support is provided on a flat bed (40). Droplets of a curable fluid are jetted from a print head (10) on the hydrophilic support. The print head scans back and forth in a transversal direction (x-direction) across the moving lithographic support (y-direction). Such bi-directional printing, also referred to as multi-pass printing, is preferred for obtaining a high throughput. The jetted curable fluid is cured by a curing device (30).

The inkjet CTP system may be a flat bed printing system wherein the lithographic support is positioned horizontal (=parallel to the ground) or vertical on a flat printing support in the inkjet CTP system (FIG. 6) or the inkjet CTP system may be a drum based inkjet printing system wherein the lithographic support is wrapped around a cylindrical printing support in the inkjet CTP system (FIG. 5).

If the inkjet CTP system is a drum based inkjet printing system, the linear velocity of the printhead in the direction Y (=along the cylindric printing support) may be locked with the rotational speed X of the cylindrical printing support, so each nozzle of the printhead jets fluid along a spiral path on the lithographic support which is wrapped around the cylindrical printing support.

The printhead in an inkjet CTP system may scan back and forth in a transversal direction across the moving of the lithographic supports. This method is also called multi pass inkjet printing. In a multi-pass printing method shingling and interlacing methods may be used as exemplified by EP 1914668 (AGFA-GEVAERT) or print mask methods may be used as exemplified by U.S. Pat. No. 7,452,046 (HEWLETT-PACKARD). The print mask in a print masks method is preferably a pseudo-random distribution mask and more preferably a pseudo-random distribution with blue-noise characteristics.

In a preferred method the jetting of the liquid is performed by single pass inkjet printing, which can be performed by using page wide printhead, such as a page wide inkjet printhead or multiple staggered inkjet printheads which cover the total width of the lithographic supports. In a single pass inkjet printing method the inkjet printheads usually remain stationary and the lithographic supports are transported once under the page wide printhead. An advantage of single pass inkjet printing is the fastness of preparation of the lithographic printing plates and a better dot placement of the jetted droplets which give a better alignment.

To avoid misunderstandings the step of printing a liquid in the present invention is a two-dimensional printing method and not a three-dimensional printing method wherein the thickness is achieved by printing the liquid top on top in a plurality of layers.

The print quality of the inkjet CTP system depends on the addressability, also called print resolution, of the system. It is in literature given as "dots per inch" or dpi. The printing pitch is the smallest distance, between to neighbour addresses, also called pixels, on which the inkjet CTP system jets its liquid. An address in an inkjet CTP system corresponds to a pixel in the raster image.

In a preferred embodiment the inkjet CTP system has a printing pitch between 1200 dots per inch (DPI) and 9600 dots per inch (DPI).

Printhead

A preferred printhead is an inkjet printhead such as a piezoelectric printhead. Inkjet printhead fire droplets of a liquid, preferably fire droplets of an ink. Piezoelectric inkjet printing is based on the movement of a piezoelectric ceramic transducer when a voltage is applied thereto. The application of a voltage changes the shape of the piezoelectric ceramic transducer in the printhead creating a void, which is then filled with ink. When the voltage is again removed, the ceramic expands to its original shape, ejecting a droplet of ink from the printhead. However the inkjet printing method according to the present invention is not restricted to piezoelectric inkjet printing. Other printheads may be used and include various types, such as a continuous type.

More information about inkjet print devices is disclosed in STEPHEN F. POND. Inkjet technology and Product development strategies. United States of America: Torrey Pines Research, 2000. ISBN 0970086008.

To obtain a sufficient resolution of the lithographic printing plates, for example 1200 or 1800 dpi, preferred printheads, such as piezoelectric inkjet printheads, jets droplets having a volume smaller than 15.0 pl, more preferably smaller than 10.0 pl, most preferably smaller than 5.0 pl, particularly preferred equal or smaller than 3.5 pl. The throwing distance between print head and lithographic support may be from 5 μm until 5000 μm.

A more preferred printhead for the inkjet CTP system is a multi-droplet piezoelectric inkjet printhead. A multi-droplet piezoelectric printhead, also called a grayscale piezoelectric printhead, is capable of jetting droplets in a plurality of volumes, such as the Konica Minolta™ KM1024i, to improve the quality of the lithographic images on the lithographic supports.

In a preferred embodiment in a piezoelectric printhead a minimum droplet size of one single jetted droplet is from 0.1 pL until 300 pL, in a more preferred embodiment the minimum droplet size is from 1 pL until 30 pL, in a most preferred embodiment the minimum droplet size is from 1.5 pL until 15 pL.

In a preferred embodiment the piezoelectric printhead has a droplet velocity from 3 meters per second until 15 meters per second, in a more preferred embodiment the droplet velocity is from 5 meters per second until 10 meters per second, in a most preferred embodiment the droplet velocity is from 6 meters per second until 8 meters per second.

In a preferred embodiment the piezoelectric printhead has a native print resolution from 25 DPI until 2400 DPI, in a more preferred embodiment the piezoelectric printhead has a native print resolution from 50 DPI until 2400 DPI and in a most preferred embodiment the piezoelectric printhead has a native print resolution from 150 DPI until 3600 DPI.

In a preferred embodiment with the piezoelectric printhead the jetting viscosity is from 5 mPa·s until 200 mPa·s more preferably from 25 mPa·s until 100 mPa·s and most preferably from 30 mPa·s until 70 mPa·s. The jetting viscosity is measured by measuring the viscosity of the liquid at the jetting temperature. The jetting viscosity may be measured with various types of viscometers such as a Brookfield DV-II+ viscometer at jetting temperature and at 12 rotations per minute (RPM) using a CPE 40 spindle which corresponds to a shear rate of 90 $s^{-1}$.

In a preferred embodiment with the piezoelectric printhead the jetting temperature is from 10° C. until 100° C. more preferably from 20° C. until 60° C. and most preferably from 30° C. until 50° C.

The nozzle spacing distance of the nozzle row in a piezoelectric printhead is preferably from 10 μm until 200 μm; more preferably from 10 μm until 85 μm; and most preferably from 10 μm until 45 μm.

Another more preferred printhead is a through-flow piezoelectric inkjet printhead. A through-flow piezoelectric inkjet printhead is a printhead wherein a continuous flow of liquid is circulating through the liquid channels of the printhead to avoid agglomerations in the liquid which may cause disturbing effects in the flow and bad dot placements. Avoiding of bad dot placements by using through-flow piezoelectric inkjet printheads is an advantage on the print quality, robustness and robustness.

A preferred printhead for the present invention is a so-called valvejet printhead. Preferred valvejet printheads have a nozzle diameter between 45 and 600 μm. The valvejet printheads comprises a plurality of micro valves, which allows for a resolution of 15 to 150 dpi which is preferred for having high productivity while not comprising image quality. A valvejet printhead is also called coil package of micro valves or a dispensing module of micro valves. The way to incorporate valvejet printheads into an inkjet printing device is well-known to the skilled person. For example, US 2012105522 (MATTHEWS RESOURCES INC) discloses a valvejet printer including a solenoid coil and a plunger rod having a magnetically susceptible shank. Suitable commercial valvejet printheads are chromoJET™ 200, 400 and 800 from Zimmer, Printos™ P16 from VideoJet and the coil packages of micro valve SMLD 300's from Fritz Gyger™.

The droplet forming means of a valvejet printhead controls a micro valve in the valvejet printhead by actuated electromagnetically to close or to open the micro valve so the medium flows through the liquid channel. Valvejet printheads may have a maximum dispensing frequency up to 3000 Hz.

In a preferred embodiment the valvejet printhead the minimum droplet size of one single droplet, also called minimal dispensing volume, is from 1 nL (=nanoliter) to 500 μm (=microliter), in a more preferred embodiment the minimum droplet size is from 10 nL to 50 μL, in a most preferred embodiment the minimum droplet size is from 10 nL to 300 μL. By using multiple single droplets, higher droplet sizes may be achieved.

In a preferred embodiment the valvejet printhead has a native print resolution from 10 DPI until 300 DPI, in a more preferred embodiment the valvejet printhead has a native print resolution from 10 DPI until 200 DPI and in a most preferred embodiment the valvejet printhead has a native print resolution from 50 DPI until 200 DPI.

In a preferred embodiment with the valvejet printhead the jetting viscosity is from 5 mPa·s until 3000 mPa·s more preferably from 25 mPa·s until 1000 mPa·s and most preferably from 30 mPa·s until 500 mPa·s.

In a preferred embodiment with the valvejet printhead the jetting temperature is from 10° C. until 100° C. more preferably from 20° C. until 60° C. and most preferably from 20° C. until 50° C.

Curing Devices

By curing, the jetted liquid is stabilized to the lithographic support. The stabilization of the jetted or printed liquid on the lithographic support ensures the placement of the droplet on the lithographic support.

In a preferred embodiment the jetted or printed liquid is cured on the lithographic support by actinic radiation, more preferably by infra-red radiation (IR) and most preferably by ultraviolet radiation. In a preferred embodiment the actinic radiation is near-infrared (NIR) or short-wavelength infrared (SWIR).

The curing device, such as a set of IR lamps, NIR lamps, SWIR, UV bulb or UV LED lamps may travelling with the printhead and/or be stationary attached as an elongated radiation source.

In a preferred embodiment the method comprises the method of controlling the time-to-cure to achieve a larger thickness of the printing area. The time-to-cure determines the drop diameter and drop thickness. The time between impacting the liquid on the lithographic support and the curing, which is the time-to-cure, is preferably between 0.1 nanosecond and 1 second.

In a preferred embodiment the method comprises a method of controlling by enhancing the power of the curing device to stabilize the jetted liquid even more to make them more chemical and mechanical resistant.

Any ultraviolet light source, as long as part of the emitted light can be absorbed by the photo-initiator or photo-initiator system in the liquid, may be employed as a radiation source, such as a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing.

UV radiation is generally classed as UV-A, UV-B, and UV-C as follows:

UV-A: 400 nm to 320 nm

UV-B: 320 nm to 290 nm

UV-C: 290 nm to 100 nm.

In a preferred embodiment, the curing device contains a set of UV LEDs with a wavelength larger than 360 nm, preferably one or more UV LEDs with a wavelength larger than 380 nm, and most preferably UV LEDs with a wavelength of about 395 nm. An advantage of using a set of UV LEDs as curing device is the fast changing of UV dose.

Furthermore, it is possible to cure the printed liquid using, consecutively or simultaneously, two light sources of differing wavelength or illuminance. For example, the first UV-source can be selected to be rich in UV-C, in particular in the range of 260 nm-200 nm. The second UV-source can then be rich in UV-A, e.g. a gallium-doped lamp, or a different lamp high in both UV-A and UV-B. The use of two UV-sources has been found to have advantages e.g. enabling a fast curing speed and a high curing degree.

For facilitating curing, the printing device often includes one or more oxygen depletion units. The oxygen depletion units place a blanket of nitrogen or other relatively inert gas (e.g. $CO_2$), with adjustable position and adjustable inert gas concentration, in order to reduce the oxygen concentration in the curing environment. Residual oxygen levels are usually maintained as low as 200 ppm, but are generally in the range of 200 ppm to 1200 ppm.

Curing may be "partial" or "full". The terms "partial curing" and "full curing" refer to the degree of curing, i.e. the percentage of converted functional groups, and may be determined by, for example, RT-FTIR (Real-Time Fourier Transform Infra-Red Spectroscopy) which is a method well known to the one skilled in the art of curable formulations. Partial curing is defined as a degree of curing wherein at least 5%, preferably 10%, of the functional groups in the coated formulation or the fluid droplet is converted. Full curing is defined as a degree of curing wherein the increase in the percentage of converted functional groups with increased exposure to radiation (time and/or dose) is negligible. Full curing corresponds with a conversion percentage that is within 10%, preferably 5%, from the maximum conversion percentage. The maximum conversion percentage is typically determined by the horizontal asymptote in a graph representing the percentage conversion versus curing energy or curing time which is the time-to-cure.

To make the printing area more sustainable, robust, mechanical and/or chemical resistance, the curing step may be a plurality of curing passes instead of a single curing pass. For example a first curing pass to immobilize the printed liquid and a second curing pass to solidify the printed liquid.

Inkjet Ink

In a preferred embodiment, the liquid is an ink, such as an inkjet ink, and in a more preferred embodiment the inkjet ink is an aqueous curable inkjet ink, and in a most preferred embodiment the inkjet ink is an UV curable inkjet ink.

A preferred aqueous curable inkjet ink includes an aqueous medium and polymer nanoparticles charged with a polymerizable compound. The polymerizable compound is preferably selected from the group consisting of a monomer, an oligomer, a polymerizable photoinitiator, and a polymerizable co-initiator.

An inkjet ink may be a colourless inkjet ink and be used. However, preferably the inkjet ink includes at least one colorant, more preferably a colour pigment. The inkjet ink may be a cyan, magenta, yellow, black, red, green, blue, orange or a spot color inkjet ink, preferable a corporate spot color inkjet ink such as red colour inkjet ink of Coca-Cola™ and the blue colour inkjet inks of VISA™ or KLM™.

In a preferred embodiment the liquid is an inkjet ink comprising inorganic particles such as a white inkjet ink.

Jetting Viscosity and Jetting Temperature

The jetting viscosity is measured by measuring the viscosity of the liquid at the jetting temperature.

The jetting viscosity may be measured with various types of viscometers such as a Brookfield DV-II+ viscometer at jetting temperature and at 12 rotations per minute (RPM) using a CPE 40 spindle which corresponds to a shear rate of 90 $s^{-1}$ or with the HAAKE Rotovisco 1 Rheometer with sensor C60/1 Ti at a shear rate of 1000 $s^{-1}$ In a preferred embodiment the jetting viscosity of the liquid is from 5 mPa·s to 200 mPa·s more preferably from 25 mPa·s to 100 mPa·s and most preferably from 30 mPa·s to 70 mPa·s. These jetting viscosies allow improving the adhesion on lithographic support and the formulation latitude of these jettable liquid allows, for example, to include oligomers and/or polymers and/or pigments in a higher amount. This results in a wider accessible lithographic support range; reduced odour and migration and improved cure speed for UV curable jettable liquids; environmental, health and safety benefits (EH&S); physical properties benefits; reduced raw material costs and/or reduced ink consumption for higher pigment loads.

The jetting temperature may be measured with various types of thermometers.

The jetting temperature of jetted liquid is measured at the output of a nozzle in the printhead, such as a valvejet printhead or piezoelectric printhead, while jetting or it may be measured by measuring the temperature of the liquid in the liquid channels or nozzle while jetting through the nozzle. In a preferred embodiment the jetting temperature is from 10° C. to 100° C. more preferably from 20° C. to 60° C. and most preferably from 30° C. to 50° C.

Measurement Methods

To analyse the maximum height of a printing area from a lithographic printing plate, the lithographic printing plate may be analyzed by a scanning electron microscope (SEM), such as a Tescan™ SEM or a Sirion™ SEM.

The result of the SEM visualizes the profilometry of the printing area such as the form and height of the cured drops in the printing area. This method is also called microscopy-profilometry.

Comparing the profilometry of a printing area of a lithographic printing plate before using the lithographic printing plate on press and the profilometry of the printing area after a certain run-length, the robustness of the lithographic printing plate can be determined. By comparing the profilometry of the printing area at several run-length, the durability of the printing plate can be determined in function of run-length.

Another measurement device is an optical profiler, such as the Wyko NT3300. By means of a multi-region-analysis it is possible to segment the dots and perform a statistical dimension analysis to calculate drop diameter and thickness of cured drops.

Drop diameter and drop deficiencies may also be measured by methods disclosed in ISO/IEC 13660:2001, for example with image quality analysis products of QEA™ such as IAS®-1000 software of QEA™ together with the ADF (Automatic Document Feeder) of QEA™.

Density and tone-value measurements may be measured with densitometers, such as GretagMacbeth™ D19C, or colorimeters or color spectrophotometers. The calculation from density to tone-value is disclosed in ISO/IEC 13660:2001.

The static contact angle of a single jetted droplet on a lithographic support can be measured by an optical system, to capture the profile of the droplet on the lithographic support. The optical system, such as photographic or video capture system, is focusing on and is capturing a jetted droplet. On the captured images an operator draws imposed asymptotes with a imaging software package wherein the angle between these imposed lines are calculated as static contact angle. Imaging software package for such purposes is DROPimage™ available by ramé-Hart™ (www.rame-hart.com).

EXAMPLES

Screening Methods

Agfa Balanced Screening™ (ABS) is a PostScript™-based amplitude modulated (AM) screening method available from Agfa Graphics N.V. For example :ABS 200 (ABS200) is a Agfa Balance Screening with 200 lines per inch (lpi) and :ABS 150 (ABS150) is a Agfa Balance Screening with 150 lines per inch (lpi).

CristalRaster™ (CR) is a frequency modulated (FM) stochastic screening method available from Agfa Graphics N.V. For example: CristalRaster 21 (CR 21) is a frequency modulated (FM) stochastic screening method wherein the uniform size of the screendots is 21 μm and wherein the frequency of screendots is varied according to the tonal value that is being reproduced.

FM28 is a frequency module (FM) stochastic screening method wherein the size of the screendots are uniform squares of 2 on 2 pixels and wherein the frequency of screendots is varied with blue-noise characteristics according to the tonal value that is being reproduced.

Liquids

OFFSETINK-01 is a magenta UV offset ink, available from Jänecke & Schneemann (www.js-druckfarben.de) and was used on the Drent™, an offset printing press, together with a fountain solution Prima FS707 web, which is available from Agfa Graphics N.V. It is known that UV offset inks impact the robustness of the state-of-the-art badly due to chemical wear.

OFFSETINK-02 is an AMRATN black coldset ink (www.amra.ch) and used on the Drent™, an offset printing press, together with a fountain solution Prima FS707 web, which is available from Agfa Graphics N.V.

IJCTPINK-03 is an Anapurna™ XLS 2500 LED Cyan UV curable ink available from Agfa Graphics N.V.

Patches

PATCH40%_CR21 is a raster image, resulting from halftoning a patch with tone-value of 40% by CR21.

PATCH40%_ABS200 is a raster image, resulting from halftoning a patch with tone-value of 40% by ABS200.

PATCH40%_FM28 is a raster image, resulting from halftoning a patch with tone-value of 40% by FM28.

PATCH40%_ABS150 is a raster image, resulting from halftoning a patch with tone-value of 40% by ABS150.

PATCH2×2 is a raster image comprising a plurality of squares of 2×2 pixels wherein the squares are not touching each other and are positioned in a regular grid.

PATCH1×1 is a raster image comprising a plurality of squares from 1×1 pixels wherein the squares are not touching each other and are positioned in a regular grid.

Comparative Lithographic Printing Plates

PP-01 is a baked :Thermostar™ P970 plate. :Thermostar™ P970 is available from Agfa Graphics N.V and imaged with a Creo™ with a 20 W thermal laser in 2400 dpi. The baking of the lithographic printing plate was done in an Haase™ oven at 220° C. during 2 minutes. PP-01 comprised printing area's that corresponds to a PATCH40%_CR21, a PATCH40%_ABS200, a PATCH2×2 and a PATCH1×1. The printing pitch was 10.58 μm and the maximum thickness of the printing area's on PP-01 was 1 μm, determined by height measurements on captured images of the printing area with a SEM. PP-01 is state-of-the-art.

PP-03 is a lithographic printing plate (PP-03) prepared by an inkjet CTP system Glunz & Jensen™ PlateWriter Series. The lithographic support of PP-03 is iPlate™ from Glunz & Jensen™. The lithographic support of PP-03 was anodized aluminium. PP-03 is state-of-the-art.

Inventive Example of a Lithographic Printing Plate

PP-02 was prepared according to the present invention by a drum-based inkjet CTP system (IJCTP-01) (FIG. 5).

a) Preparation a Lithographic Support

A 0.3 mm thick aluminium foil was degreased by spraying its surface with an aqueous solution containing 34 g/l NaOH at 70° C. for 6 seconds followed by rinsing it with demineralised water for 3.6 seconds. The foil was then electrochemically grained during 8 seconds using an alternating current in an aqueous solution containing 15 g/l HCl, 15 g/l $SO_4^{2-}$-ions and 5 g/l $Al^{3+}$ ions at a temperature of 37° C. and a current density of about 100 A/dm2 (charge density of about 800 C/dm$^2$).

Afterwards, the aluminium foil was desmutted by etching with an aqueous solution containing 6.5 g/l of sodium hydroxide at 35° C. for 5 seconds and rinsed with demineralised water for 4 seconds. The foil was subsequently subjected to anodic oxidation during 10 seconds in an aqueous solution containing 145 g/l of sulfuric acid at a temperature of 57° C. and an anodic charge of 250 C/dm$^2$, then washed with demineralised water for 7 seconds and dried at 120° C. for 7 seconds.

The grained and anodized aluminium support thus obtained was characterised by a surface roughness Ra of 0.45-0.50 μm (measured with interferometer NT3300 and had an anodic weight of about 3.0 g/m$^2$ (gravimetric analysis). The dimension of the aluminium support was 50 cm×25 cm.

The above described support was then silicated by spraying a sodium silicate solution (25 g/l sodium silicate in water) onto it for 4 seconds at 70° C., followed by a rinsing step with demineralised water for 3.5 seconds and a drying step at 120° C. for 7 seconds.

Subsequently, the silicated support was coated with a fluorosurfactant solution (4 g/l Zonyl FSA and 4 g/l potassium nitrate in demineralised water) at a wet coating thickness of 10 μm. The substrate was dried for 5 seconds at 120° C.

b) Printing the Printing Areas

The lithographic support is wrapped around the drum of IJCTP-01.

The specification of the drum of IJCTP-01 were the following:

drum circumference: 434 mm drum speed: 350 mm/s

The specification of the printheads of IJCTP-01 were the following:

number of printheads: 4 type of printheads: Toshiba TEC™ CA5 liquid in printheads: IJCTPINK-03 throwing distance: 800 μm

The specification of a UV LED-module (UV-01) of IJCTP-01 while printing were the following:

Supplier UVLED-module: Baldwin™ number of LED rows: 4

LED power: 20%

UV dose: 0.1488 J/cm$^2$ time-to-cure: 620 μs at drum speed of 350 mm/s

PP-02 comprised printing area's that corresponds to a PATCH40%_FM28, PATCH40%_ABS150, PATCH2×2 and PATCH1×1.

The maximum thickness of the printing area was more than 10 μm, determined by optical profilometry.

Example 1 and Example 2

In the following two examples the chemical and mechanical resistance of the two lithographic printing plates (PP-01, PP-02) were evaluated. Print tests with both plates were carried out on a Drent™, an offset printing press, using newspaper stock 45 g/m$^2$ paper and two different types of printing (OFFSETINK-01, OFFSETINK-02). The press-life of a lithographic printing plate is measured by the maximum run-length of prints where the print quality is acceptable.

The press-life of the two lithographic printing plates (PP-01, PP-02) were evaluated by measuring the tone-value of a raster image on print. The raster image was a result of halftoning a patch with tone-value of 40%. (PATCH40%_CR21, PATCH40%_ABS200, PATCH40%_FM28, PATCH40%_ABS150). The tone-value of these patches on print was measured with a Gretag optical densitometer D19C. The tone-value on print was compared to the Average Tone-value of prints 10000, 20000 and 30000 (AvTV). The print quality on print was evaluated as follows:

tone-value ≥AvTV: good (++)

tone-value ≥AvTV−4%: acceptable (+)

tone-value <AvTV−4%: not acceptable (−)

Figure 2:
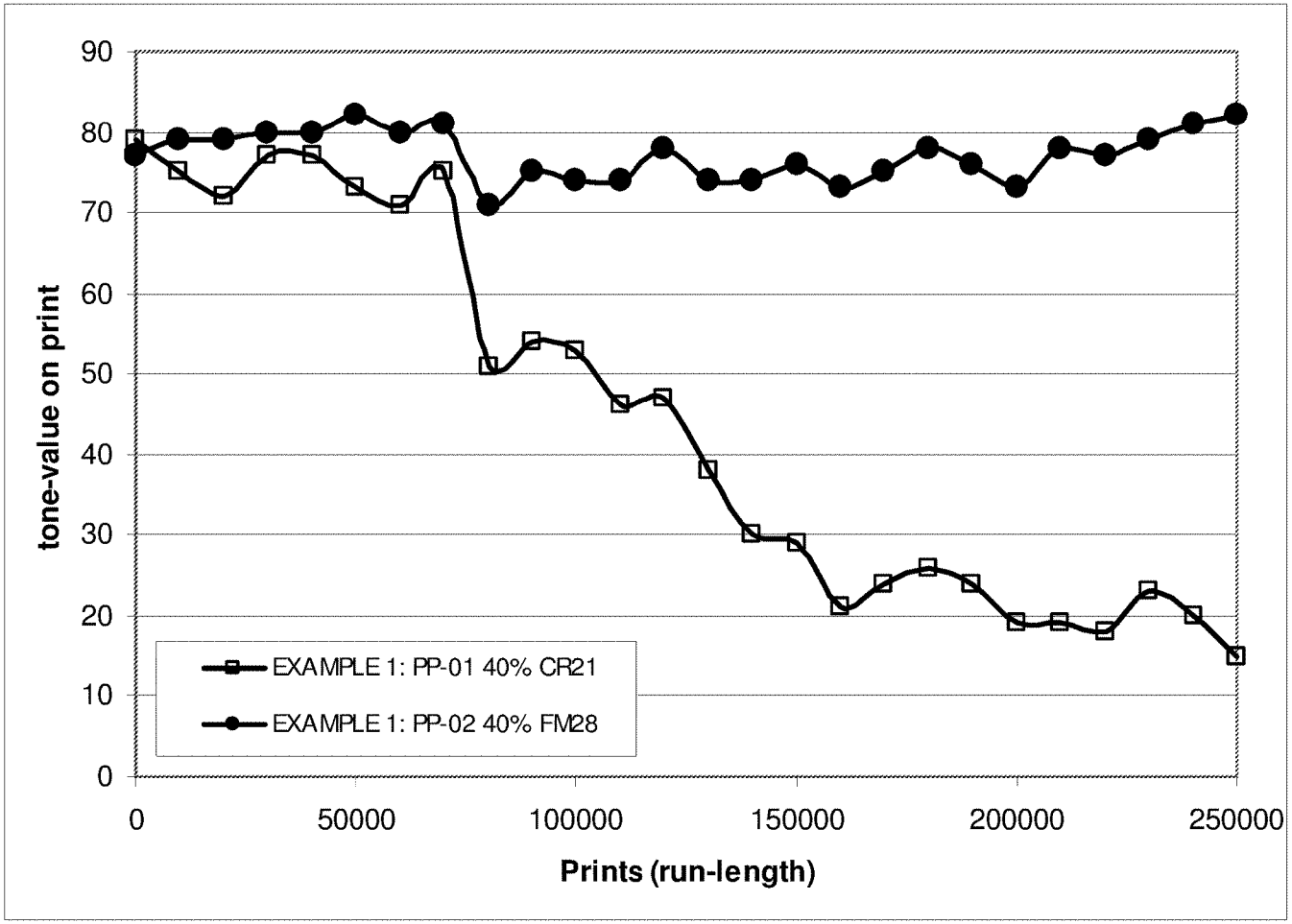
In FIG. 2, the tone-values on print of a 40% patch of the lithographic printing plates PP-01 (Comparative Example) and PP-02 (Inventive example) are given as function of the number of prints. The 40% patches were halftoned with an FM screening method. OFFSETINK-01 was used as printing ink.

EXAMPLE 1 is the evaluation of the press-life for the lithographic printing plate PP-01 and PP-02, carried out on a Drent™ and using OFFSETINK-01 as offset ink. The evaluation is shown in Table 1, FIG. 1 and FIG. 2.

The quality of the conventional CTP lithographic printing plate PP-01 was declined very fast after 80000 prints for both screening methods (PATCH40%_ABS200 and PATCH40%_CR21). The quality of the lithographic printing plate PP-02 remained stable even after more than 160000 prints for both screening methods (PATCH40%_ABS150 and PATCH40%_FM28).

TABLE 1

| Prints | PP-01 40% ABS200 | PP-01 40% CR 21 | PP-02 40% ABS150 | PP-02 40% FM28 |
|---|---|---|---|---|
| 120000 | 73% (++) | 36% (−−) | 74% (++) | 78% (++) |
| 160000 | 51% (−−) | 22% (−−) | 65% (−−) | 73% (++) |
| 200000 | 50% (−−) | 8% (−−) | 64% (−−) | 73% (++) |
| AvTV | 70% | 75% | 72% | 70% |

Figure 3:
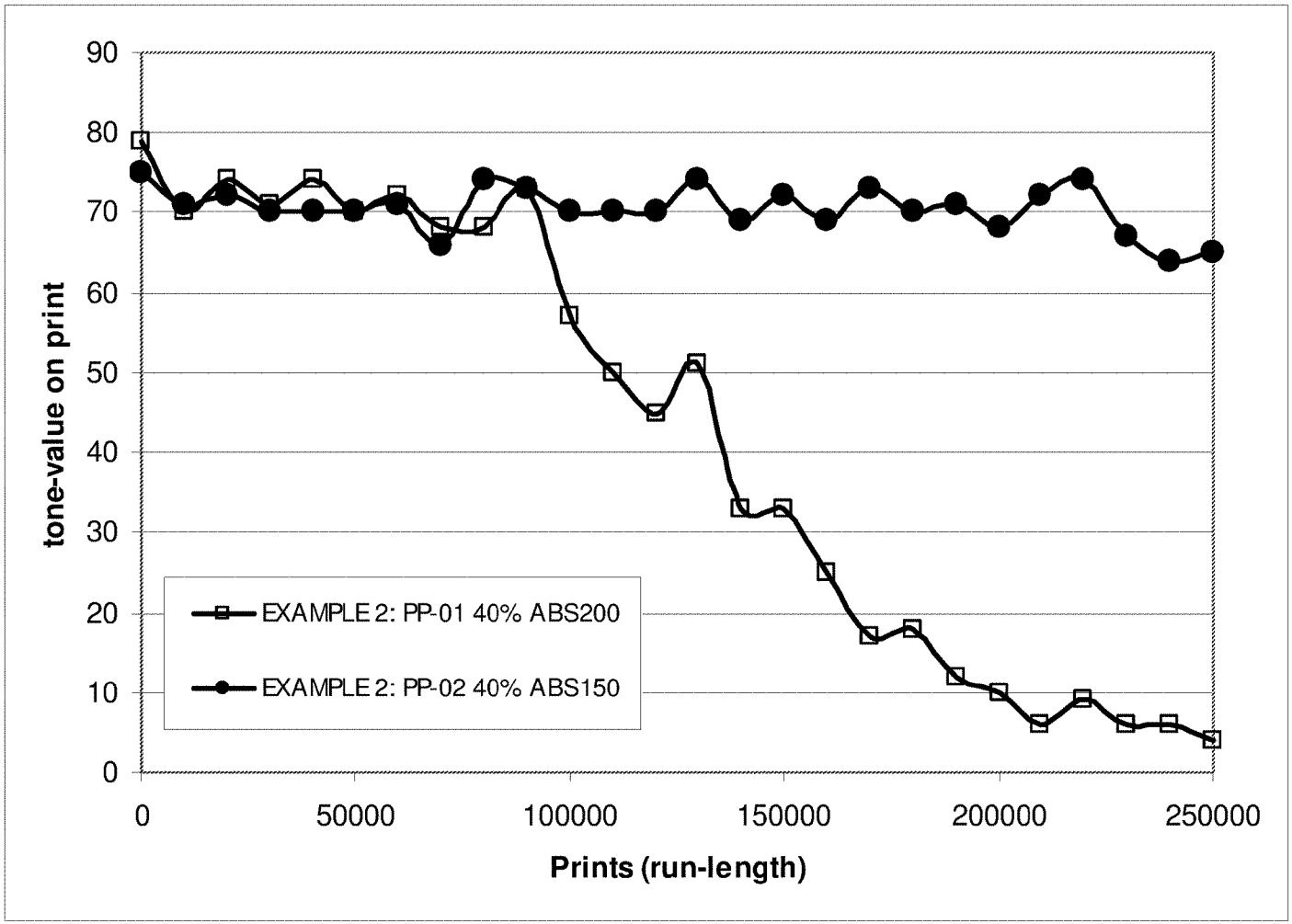
In FIG. 3, the tone-values on print of a 40% patch of the lithographic printing plates PP-01 (Comparative Example) and PP-02 (Inventive example) are given as function of the number of prints. The 40% patches were halftoned with an AM screening method. OFFSETINK-02 was used as printing ink.
Figure 4:
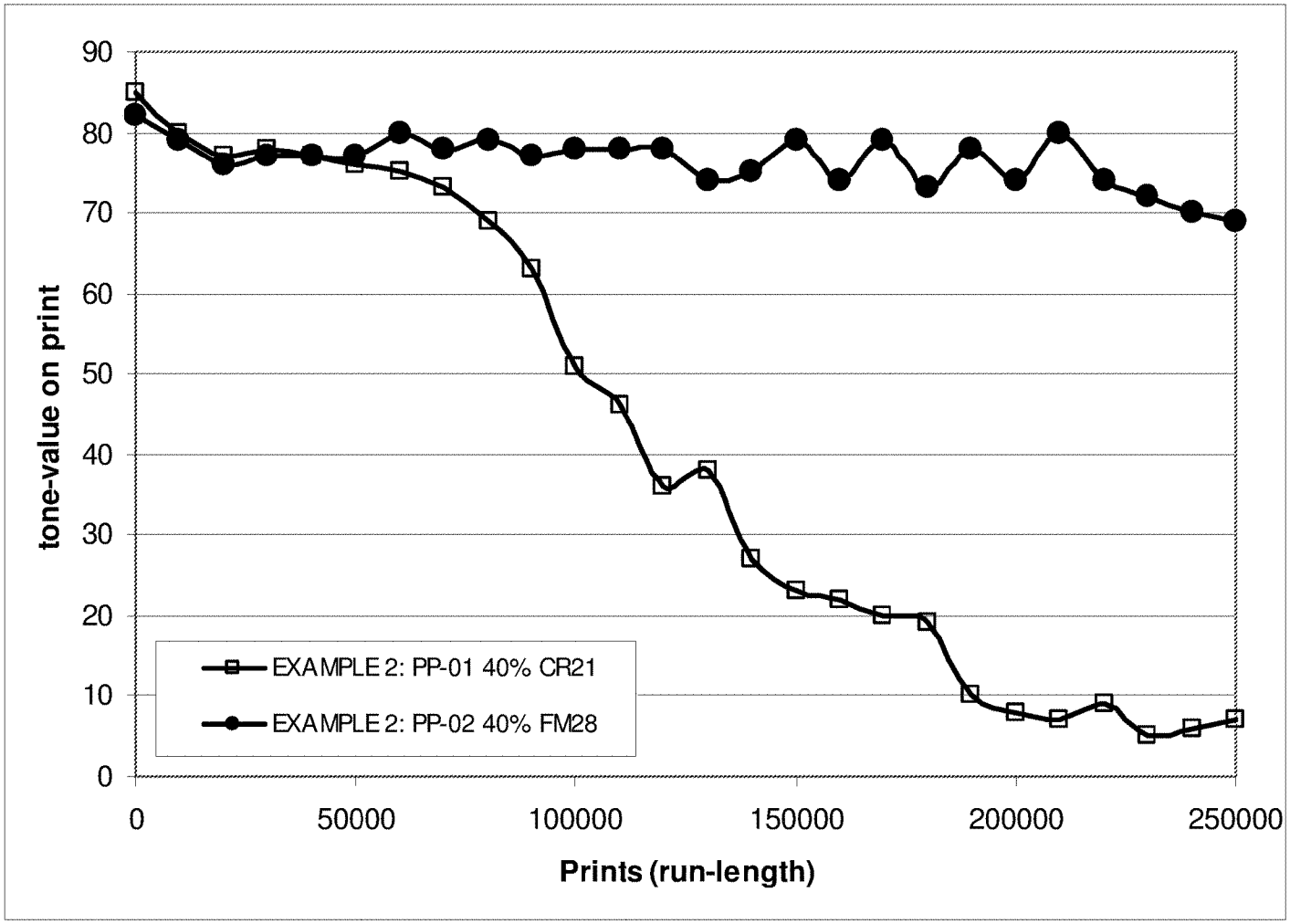
In FIG. 4, the tone-values on print of a 40% patch of the lithographic printing plates PP-01 (Comparative Example) and PP-02 (Inventive example) are given as function of the number of prints. The 40% patches were halftoned with an FM screening method. OFFSETINK-02 was used as printing ink.

EXAMPLE 2 is the evaluation of the press-life for the lithographic printing plate PP-01 and PP-02, carried out on a Drent™ and using OFFSETINK-02 as offset ink. The evaluation is shown in Table 2, FIG. 3 and FIG. 4.

The quality of the conventional CTP lithographic printing plate PP-01 was declined very fast after 80000 prints for both screening methods (PATCH40%_ABS200 and PATCH40%_CR21). The quality of the lithographic printing plate PP-02 remained stable even after more than 160000 prints for both screening methods (PATCH40%_ABS150 and PATCH40%_FM28).

TABLE 2

| Prints | PP-01 40% ABS200 | PP-01 40% CR 21 | PP-02 40% ABS150 | PP-02 40% FM28 |
|---|---|---|---|---|
| 120000 | 45% (−−) | 36% (−−) | 70% (+) | 78% (++) |
| 160000 | 25% (−−) | 22% (−−) | 69% (+) | 74% (+) |
| 200000 | 19% (−−) | 8% (−−) | 68% (+) | 74% (+) |
| AvTV | 72% | 78% | 71% | 77% |

Example 3

EXAMPLE 3 is the evaluation of the press-life, especially the abrasion, for the lithographic printing plate PP-01 and PP-02, carried out on a Drent™ and using OFFSETINK-02 as offset ink.

Figure 7:
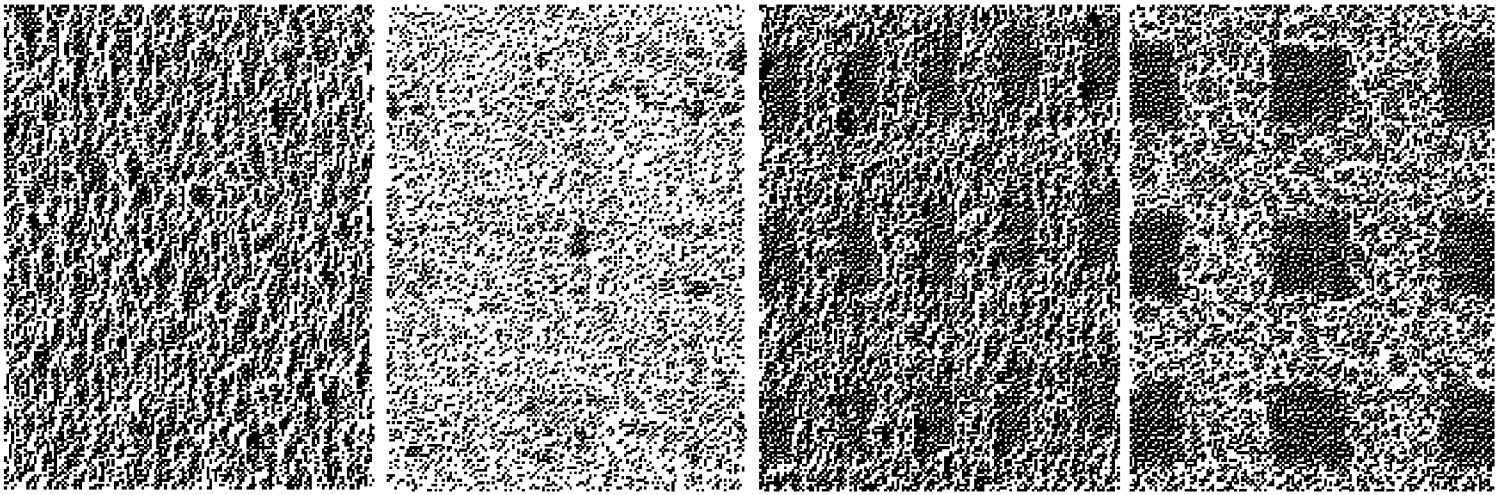
In FIG. 7, SEM-images from the conventional lithographic printing plate PP-01 before EXAMPLE 2 was started and after a run-length of 250000 prints EXAMPLE 2 was ended. The top SEM-image is captured by a SEM from TESCANTN in top view from a PATCH2×2 patch before EXAMPLE 2 was started. The image below the top image is captured by the SEM in 60 degrees tilted view from the PATCH2×2 patch before EXAMPLE 2 was started. The bottom image is captured by the SEM in 60 degrees tilted view from the PATCH2×2 patch after a run-length of 250000 prints. The image above the bottom image is captured by the SEM in top view after a run-length of 250000 prints. The dimension of the squared shapes, part of the printing area, in the top image is 21 μm on 21 μm, the other images have the same scale.
Figure 8:
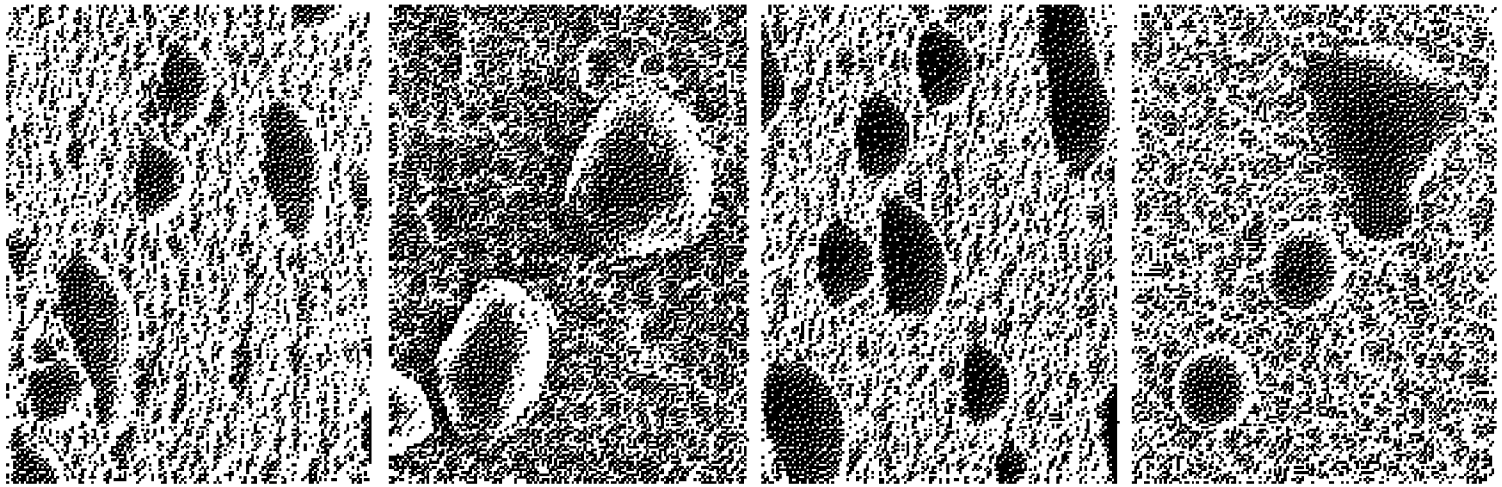
FIG. 8 illustrates 4 images from the conventional lithographic printing plate PP-02 before EXAMPLE 2 was started and after a run-length of 250000 prints EXAMPLE 2 was ended. The top image is captured by a SEM (from TESCAN) in top view from a PATCH2×2 patch before EXAMPLE 2 was started. The image below the top image is captured by the SEM in 60 degrees tilted view from the PATCH2×2 patch before EXAMPLE 2 was started. The bottom image is captured by the SEM in 60 degrees tilted view from the PATCH2×2 patch after a run-length of 250000 prints. The image above the bottom image is captured by the SEM in top view after a run-length of 250000 prints. The images have the same scale as in FIG. 7.

The SEM images in FIGS. 7 and 8 show an enlargement from a PATCH2×2 at the start and after 250000 prints with OFFSETINK-02 and PP-01 (FIG. 7) and PP-02 (FIG. 8). The dark squares, which are the ink-accepting dots, in the printing area of PATCH2×2 on PP-01 totally disappeared after 250000 prints while the rounded conical shape of the cured drops in the printing area of patch PATCH2×2 on PP-02 are still visible after 250000 prints.

Example 4

In this example, the influence of the curing step on the thickness of the printing area of a printing plate prepared by the inkjet CTP system (IJCTP-01 is looked at.

a) Preparation a Lithographic Support

The lithographic support was similar prepared as in EXAMPLE 1.

b) Printing the Printing Areas 3 pL droplets were jetted with the inkjet CTP system IJCTP-01 on the lithographic support wherein the droplets were not touching each other on the lithographic support and then cured at different UV dose with UV LED-module (UV-01) to form cured single drops. Measuring the heights of the cured single drops is equivalent as measuring the thickness of a printing area. The heights of the cured droplets were measured with a Wyko NT3300 optical profiler. For these optical measurements an automated stage has been programmed to obtain a stitched area, build up by individual overlapping scans. Each scan has been measured with a 50× magnification and 0.5×FOV lens resulting in a field-of-view of 246 μm×187 μm. By means of a multi-region-analysis it is possible to segment the dots and perform a statistical dimension analysis.

The height and diameter of the cured single drops are shown in Table 3. By controlling the UV dose in the curing step, the height and the diameter of the cured drops may be controlled.

TABLE 3

| UV dose | Average height | Drop diameter |
|---|---|---|
| 0.1488 J/cm$^2$ | 7.35 μm | 22.3 μm |
| 0.1116 J/cm$^2$ | 8.22 μm | 22.5 μm |
| 0.0744 J/cm$^2$ | 7.94 μm | 20.5 μm |
| 0.0521 J/cm$^2$ | 6.70 μm | 24.7 μm |
| 0.0372 J/cm$^2$ | 6.92 μm | 29.6 μm |

Example 5

This example illustrates the abrasion of the print areas of PP-02 and during printing (see EXAMPLE 1 and EXAMPLE 2).

Table 4 shows the average height of PATCH2×2 on the lithographic printing plate PP-02 at start and after a after a run-length of 250000 prints with OFFSETINK-01 and OFFSETINK-02 on the Drent™ (See also FIG. 8). The heights are measured on a Wyki NT3300 optical profiler as described above.

TABLE 4

| Lithographic printing plate | PP-02 at start | PP-02/ OFFSETINK-01 | PP-02/ OFFSETINK-02 |
|---|---|---|---|
| Prints | 0 | 250000 | 250000 |
| PATCH2X2: Average Height | 9.0 μm | 6.1 μm | 5.6 |

Example 6

In this example, the height of the printing area from a state-of-the-art lithographic printing plate prepared by an inkjet CTP system is looked at.

Figure 9:
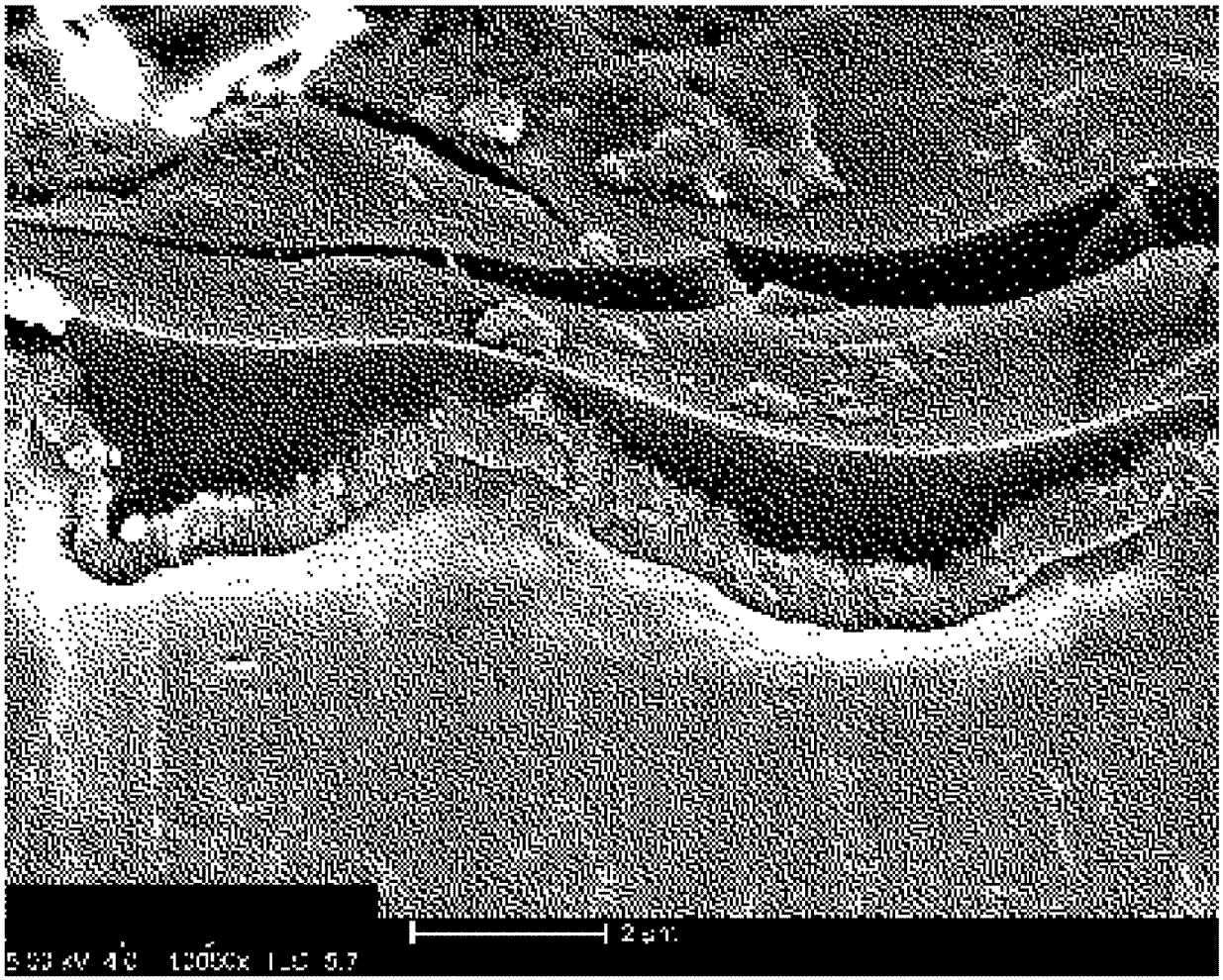
FIG. 9 illustrates an image captured by a SEM of a cross-cut through a printing area on an iPlate™ from Glunz & Jensen™ (PP-03) (see EXAMPLE 6). The white intermittent arrow shows the thickness of the printing area and the horizontal white arrow show the scaling of the SEM (The length of the horizontal white arrow is equal to 2 μm in the SEM-image).
Figure 10:
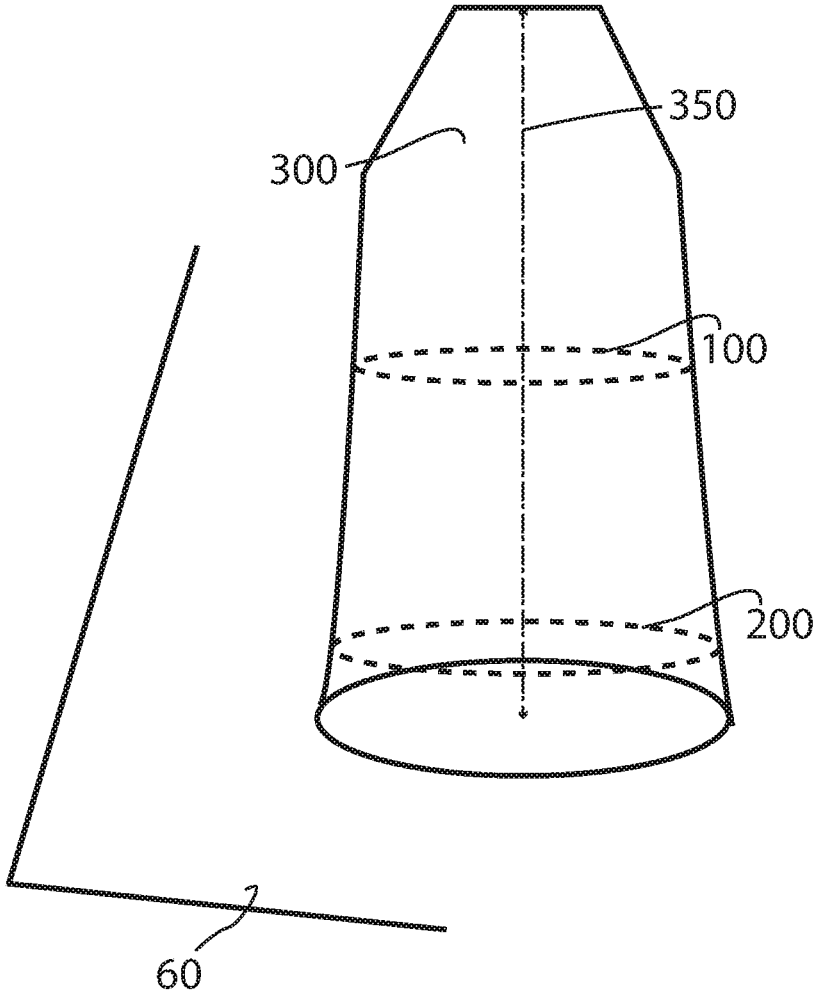
FIG. 10 shows a cured ink accepting drop 300 on a support 60 including a first section 100 having a shape defining an outer edge with a first minimum covering circle and a second section 200 having a shape defining an outer edge with a second minimum covering circle, and a height 350 of the cured ink accepting drop from the support 60 that corresponds to a maximum thickness of the cured ink accepting drop.

The printing area of the lithographic printing plate PP-03 was analyzed by a scanning electron microscope (SEM) to measure the height of the printing area which varied between 0.6 μm and 2 μm. The SEM-image of the printing area is shown in FIG. 9.

REFERENCE SIGNS LIST

| | |
|---|---|
| 1 | inkjet CTP system |
| 10 | printhead |
| 30 | curing device |
| 40 | flat bed |
| 50 | cylindrical drum |

The invention claimed is:

1. A method of preparing a lithographic printing plate comprising the steps of:

jetting liquid droplets onto a lithographic support to define a printing area that corresponds to a raster image; and curing the jetted liquid droplets on the lithographic support to define a plurality of cured drops as the printing area; wherein the raster image includes a section having a tone-value from 90% to 100%;

after the step of curing, the jetted liquid droplets in a portion of the printing area that corresponds to the section having the tone-value from 90% to 100% do not contact each other at a top of the jetted liquid droplets; and when the section of the raster image has a tone-value of 100%, the portion of the printing area has a tone-value of no more than 98%.

2. The method of preparing a lithographic printing plate according to claim 1, wherein a static contact angle of the jetted liquid droplets on the lithographic support is from 50 degrees to 110 degrees.

3. The method of preparing a lithographic printing plate according to claim 1, wherein a maximum thickness of the printing area, after the step of curing, is between 4.0 μm and 50.0 μm.

4. The method of preparing a lithographic printing plate according to claim 1, wherein the liquid is a UV curable inkjet liquid, and the step of curing includes UV bulb curing or UV LED curing.

5. The method of preparing a lithographic printing plate according to claim 1, wherein the step of jetting the liquid droplets onto the lithographic support is performed by a single pass inkjet method.

6. The method of preparing a lithographic printing plate according to claim 1, wherein the lithographic support is a grained and anodized aluminum support.

7. The method of preparing a lithographic printing plate according to claim 6, wherein a static contact angle of the jetted liquid droplets on the lithographic support is from 50 degrees to 110 degrees.

8. The method of preparing a lithographic printing plate according to claim 7, wherein a maximum thickness of the printing area, after the step of curing, is between 4.0 μm and 50.0 μm.

9. The method of preparing a lithographic printing plate according to claim 8, wherein the liquid is a UV curable inkjet liquid, and the step of curing includes UV bulb curing or UV LED curing.

10. The method of preparing a lithographic printing plate according to claim 9, wherein the UV curable inkjet liquid is jetted with a jetting viscosity from 25 mPa·s to 100 mPa·s.

11. The method of preparing a lithographic printing plate according to claim 6, wherein the raster image corresponds to a color separation; and a chroma difference, defined in CIELab, between a color of the color separation and a color of the cured jetted liquid droplets is smaller than 10.

12. A lithographic printing plate comprising:

a lithographic support; and an image-wise distribution of cured ink accepting drops on the lithographic support that represent a raster image; wherein a portion of the image-wise distribution of ink accepting drops corresponds to a section of the raster image having a tone-value from 90% to 100%;

the cured ink accepting drops do not contact each other; and each of the cured ink accepting drops has a height, corresponding to a maximum thickness of the cured ink accepting drop, between 4.0 μm and 50.0 μm.

13. The lithographic printing plate according to claim 12, wherein the cured ink accepting drops include crosslinked monomers and/or crosslinked oligomers.

14. The lithographic printing plate according to claim 12, wherein the lithographic support is a grained and anodized aluminum support.

15. The lithographic printing plate according to claim 14, wherein the cured ink accepting drops include crosslinked monomers and/or crosslinked oligomers.

16. The lithographic printing plate according to claim 15, wherein the raster image corresponds to a color separation; and a chroma difference, defined in CIELab, between a color of the color separation and a color of the cured jetted liquid droplets is smaller than 10.

* * * * *